US011011874B2

(12) United States Patent
Kitazawa

(10) Patent No.: US 11,011,874 B2
(45) Date of Patent: May 18, 2021

(54) CONNECTOR AND CONNECTOR ASSEMBLY

(71) Applicant: Molex, LLC, Lisle, IL (US)

(72) Inventor: Sho Kitazawa, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/749,998

(22) Filed: Jan. 23, 2020

(65) Prior Publication Data

US 2020/0244011 A1 Jul. 30, 2020

(30) Foreign Application Priority Data

Jan. 29, 2019 (JP) ..... JP2019-013196

(51) Int. Cl.
*H01R 13/6585* (2011.01)
*H01R 12/71* (2011.01)
*H01R 13/631* (2006.01)

(52) U.S. Cl.
CPC ..... *H01R 13/6585* (2013.01); *H01R 12/716* (2013.01); *H01R 13/631* (2013.01)

(58) Field of Classification Search
CPC ..... H01R 13/6585; H01R 13/631; H01R 12/716; H01R 13/6586
See application file for complete search history.

(56) References Cited

U.S. PATENT DOCUMENTS

| | | | | |
|---|---|---|---|---|
| 7,074,085 | B2 * | 7/2006 | Chen | H01R 13/658 439/607.36 |
| 7,367,816 | B2 * | 5/2008 | Liu | H01R 12/52 439/74 |
| 9,450,340 | B2 * | 9/2016 | Uratani | H01R 13/6585 |
| 9,478,902 | B2 * | 10/2016 | Komoto | H01R 13/627 |
| 10,159,162 | B2 | 12/2018 | Son et al. | |
| 10,396,479 | B2 * | 8/2019 | Hoshiba | H01R 13/646 |
| 2006/0178022 | A1 | 8/2006 | Liu | |
| 2010/0248503 | A1 * | 9/2010 | Kang | H01R 24/50 439/63 |
| 2018/0198241 | A1 * | 7/2018 | Ooi | H01R 13/6471 |
| 2019/0280409 | A1 * | 9/2019 | Hoshiba | H01R 13/646 |

FOREIGN PATENT DOCUMENTS

| | | | |
|---|---|---|---|
| CN | 2882007 | Y | 3/2007 |
| CN | 202260005 | U | 5/2012 |
| CN | 106025710 | A | 10/2016 |
| CN | 109904648 | A | 6/2019 |
| CN | 110401074 | A | 11/2019 |
| JP | 4576226 | B2 | 11/2010 |

* cited by examiner

*Primary Examiner* — Briggitte R. Hammond

(57) ABSTRACT

A mating guide part formed with a mating recess part that has a substantially rectangular shaped in a plan view with a first high frequency connection unit mounted therein is included, the first high frequency connection unit includes a first high frequency terminal and a square tube shaped first high frequency shield with a substantially rectangular cross section extending in the mating direction enclosing around the first high frequency terminal, the second connector includes a counterpart mating guide part that has a substantially rectangular shape in a plan view with a second high frequency connection unit mounted therein, and the second high frequency connection unit includes a second high frequency terminal and a square tube shaped second high frequency shield with a substantially rectangular cross section that extends in the mating direction enclosing around the second high frequency terminal.

8 Claims, 9 Drawing Sheets

CONNECTOR AND CONNECTOR ASSEMBLY

RELATED APPLICATIONS

This application claims priority to Japanese Application No. 2019-013196 filed on Jan. 29, 2019, which is incorporated herein by reference in its entirety.

TECHNICAL FIELD

The present disclosure relates to a connector and a connector assembly.

BACKGROUND ART

Conventionally, connectors such as board to board connectors, etc., have been used to electrically connect pairs of parallel circuit boards together. Such connectors are attached to each mutually facing surface on pairs of circuit boards and mated together so as to be connected. In addition, a connector integrated with a coaxial connector for connecting a coaxial cable used to transmit high frequency signals is proposed, for example, as an antenna wire that is connected to an antenna (for example, see patent reference 1).

FIGS. 9A and 9B are perspective drawings showing a conventional connector. Note that, in the drawings, FIG. 9A is a perspective view as viewed from a mating surface side of a first connector and FIG. 9B is a perspective view as viewed from a mating surface side of a second connector.

In the drawings, 811 is a first housing of the first connector mounted on a first circuit board (not shown) and includes an insertion recess 812, with side parts 814 formed on both sides and a first end part 821 formed on both ends in the longitudinal direction of this insertion recess 812. Furthermore, each of the side parts 814 are equipped with a first line of a plurality of first terminals 861. Also, a first coaxial connector hold part 841 that holds a first coaxial connector 871 extends from one of the first end parts 821.

In addition, 911 is a second housing of the second connector mounted on a second circuit board (not shown) that extends in the longitudinal direction and includes a second end part 921 formed on both ends in the longitudinal direction. Furthermore, the second housing 911 is equipped with a second line of a plurality of second terminals 961. Also, a second coaxial connector hold part 941 that holds the second coaxial connector 971 extends from one of the second end parts 921.

Furthermore, when the first connector and second connector are mated, the second housing 911 is inserted into the insertion recess 812 and the mutually matched first terminals 861 and second terminals 961 come into contact. In addition, the first coaxial connector 871 and a second coaxial connector 971 mate and are connected. Thus, electrical conductors connected to the first terminals 861 formed on the first circuit board (not shown) and electrical conductors connected to the second terminals 961 formed on the second circuit board (not shown) mutually conduct enabling transmitting of power and signals. In addition, a coaxial cable (not shown) connected to the first coaxial connector 871 and a coaxial cable (not shown) connected to the second coaxial connector 971 mutually conduct and can transmit high frequency signals.

Patent Document 1: Japanese Unexamined Patent Application Publication No. 2006-185773

SUMMARY

However, this type of conventional connector cannot handle the size reduction and increased signal speeds of recent electronic devices. The cases of electronic devices such as laptop computers, tablets, smartphones, digital cameras, music players, game devices, and navigation devices have been reduced in size and have become low profile. Therefore, there is demand for size reduction and low profile for associated components. In addition, there is demand for increased signal speed to deal with increased amounts of communication data and higher communication speeds and data processing speeds. However, with the conventional connectors, the size of the first housing 811 and second housing 911 in the thickness direction is large and the first coaxial connector 871 and second coaxial connector 971 are large and are therefore unable to sufficiently fulfill the demand for connector size reduction and low profile. Furthermore, with speed increase of various types of signals, there is demand for not one but a plurality of signal lines transmitting high frequency signals; however, with the conventional connector, because there is only one each of the first coaxial connector 871 and second coaxial connector 971, this demand cannot be fulfilled Even if a plurality of the first coaxial connector 871 and second coaxial connector 971 were provided, the fact that this would dramatically increase the size of the conventional connector can easily be imagined.

Here, an objective is to resolve the problems of the conventional connectors, enable a high frequency connection unit with high space efficiency to be mounted, and to provide a highly reliable connector and connector assembly that is small and has low profile, enables connecting a plurality of high frequency signal lines, and achieves high shielding effect for high frequency terminals.

Therefore, a first connector is a first connector that mates with a second connector, and includes a first connector body, a first terminal mounted on this first connector body, and a first high frequency connection unit mounted on this first connector body. The first connector body includes a recess part for mating with the second connector body of the second connector, and a mating guide part that is formed on both ends in a longitudinal direction, is a mating recess part formed with a substantially rectangular shape in a plan view with a first high frequency connection unit mounted therein, and is formed with a mating recess part that the counterpart mating guide part of the second connector body is inserted into. The first high frequency connection unit includes a first high frequency terminal and a square tube shaped first high frequency shield with a substantially rectangular cross section extending in the mating direction surrounding around the first high frequency terminal.

Another first connector has a plurality of first high frequency connection units arranged in a width direction of the first connector body.

Furthermore, for the first connector, the first high frequency shield includes a first shield member provided on the wall of the mating guide part and a shield plate provided on the bottom plate of the mating recess part extending in the longitudinal direction of the first connector body.

A second connector is a second connector that mates with the first connector, and includes a second connector body, a second terminal mounted on this second connector body, and a second high frequency connection unit mounted on this second connector body. The second connector body includes a mating guide part that is formed on both ends in a longitudinal direction, is inserted into the mating recess part of the first connector body, and is a mating guide part formed with a substantially rectangular shape in a plan view with a second high frequency connection unit mounted therein. The second high frequency connection unit includes a second high frequency terminal for connecting with the first high frequency terminal of the first connector and a square tube shaped second high frequency shield with a substantially rectangular cross section extending in the mating direction enclosing around the second high frequency terminal.

Another second connector has a plurality of second high frequency connection units arranged in a width direction of the second connector body.

Another second connector has the second high frequency terminal connected in one location to the first high frequency terminal.

Another second connector has the counterpart mating guide part made up of a second high frequency terminal stowage recess part that stows the second high frequency terminal and the second high frequency shield is attached enclosing around the second high frequency terminal stowage recessed part.

A connector assembly includes a first connector made up of a first connector body, a first terminal mounted on this first connector body, and a first high frequency connection unit mounted on this first connector body; a second connector made up of a second connector body, a second terminal mounted on this second connector body, and a second high frequency connection unit mounted on this second connector body and that mates with the first connector. The first connector body includes a recess part that mates with the second connector body, and a mating guide part formed on both ends in the longitudinal direction and that has a substantially rectangular shaped mating recess part in a plan view with a first high frequency connection unit mounted therein. The first high frequency connection unit includes a first high frequency terminal and a square tube shaped first high frequency shield extending in the mating direction enclosing around the first high frequency terminal; the second connector body includes a counterpart mating guide part formed on both ends in the longitudinal direction for insertion of the mating recess part, and is formed with a substantially rectangular shape in a plan view with a second high frequency connection unit mounted; and the second high frequency connection unit includes a second high frequency terminal that comes into contact with the first high frequency terminal and a square tube shaped second high frequency shield with a substantially rectangular cross section extending in the mating direction enclosing around the second high frequency terminal and is inserted into the first high frequency shield.

With this disclosure, a high frequency connection unit with high space efficiency can be mounted, a plurality of high frequency signal lines can be connected with small size and low profile, high shielding effect for high frequency terminals can be achieved, and reliability is improved.

BRIEF DESCRIPTION OF DRAWINGS

FIG. 8A is a plan view of the first connector as viewed from above, FIG. 8B is a cross sectional view along the A-A line, and FIG. 8C is a cross sectional view along the B-B line.

FIG. 9A is a perspective view of the first connector as viewed from the mating plane and FIG. 9B is a perspective view of the second connector as viewed from the mating plane.

DETAILED DESCRIPTION OF THE PREFERRED EMBODIMENTS

An embodiment will be described in detail below with reference to the drawings.

Figure 1:
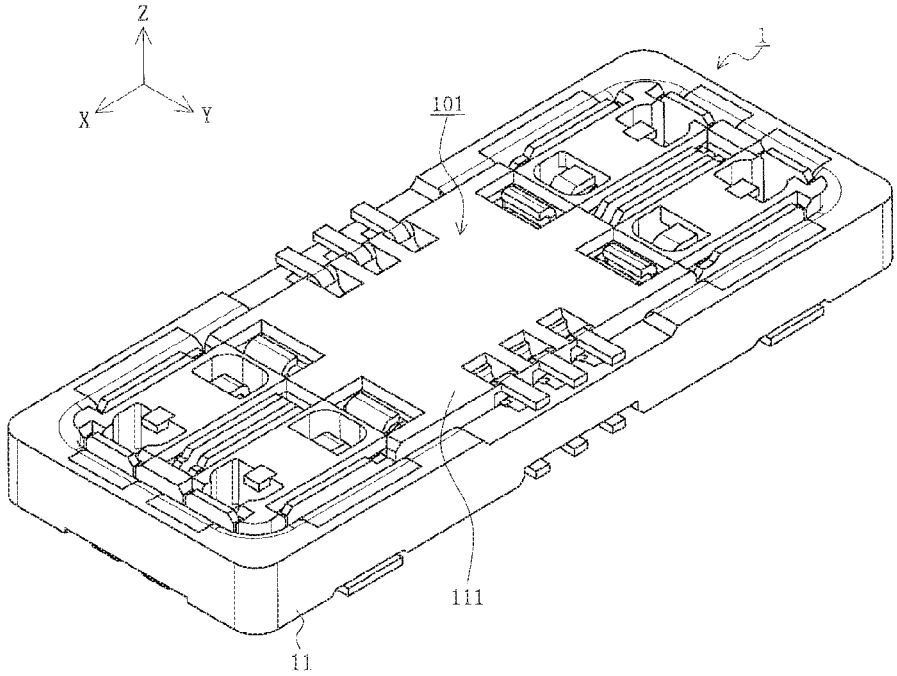
FIG. 1 is a perspective view of a state in which a first connector and a second connector according to the present embodiment are mated.
Figure 2:
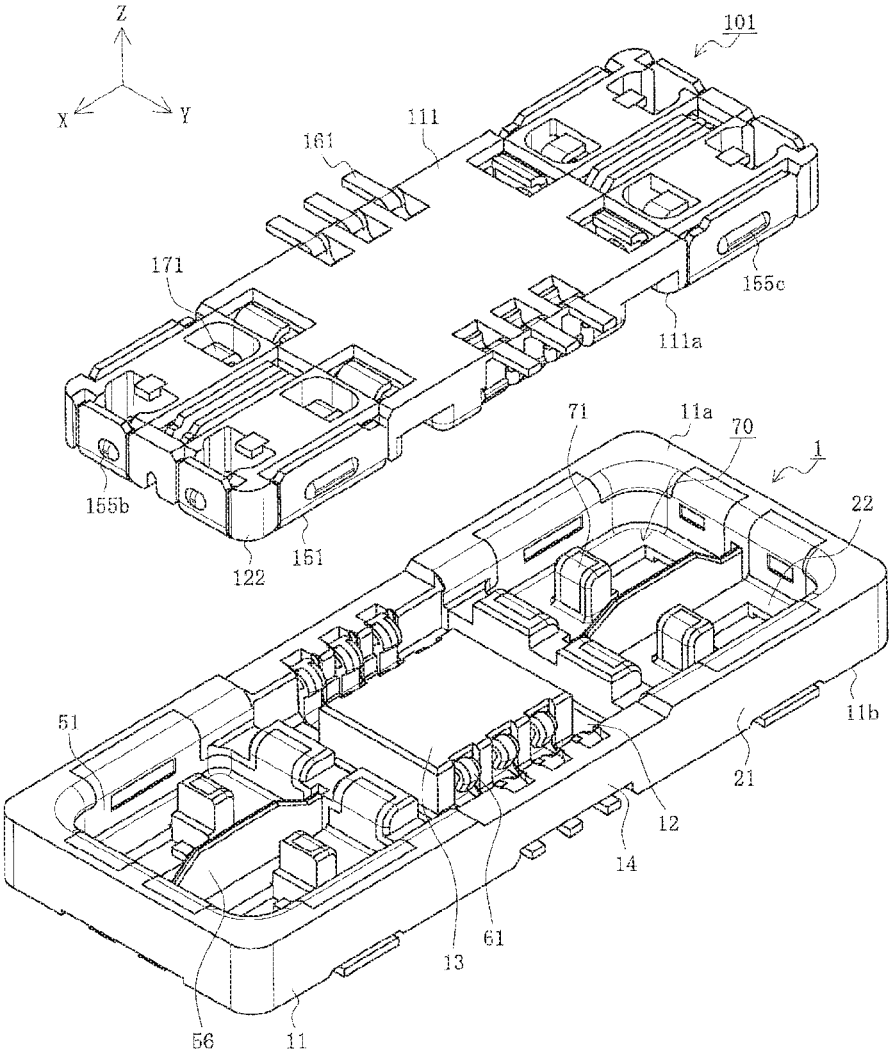
FIG. 2 is a perspective view of the first connector and the second connector according to the present embodiment.
Figure 3:
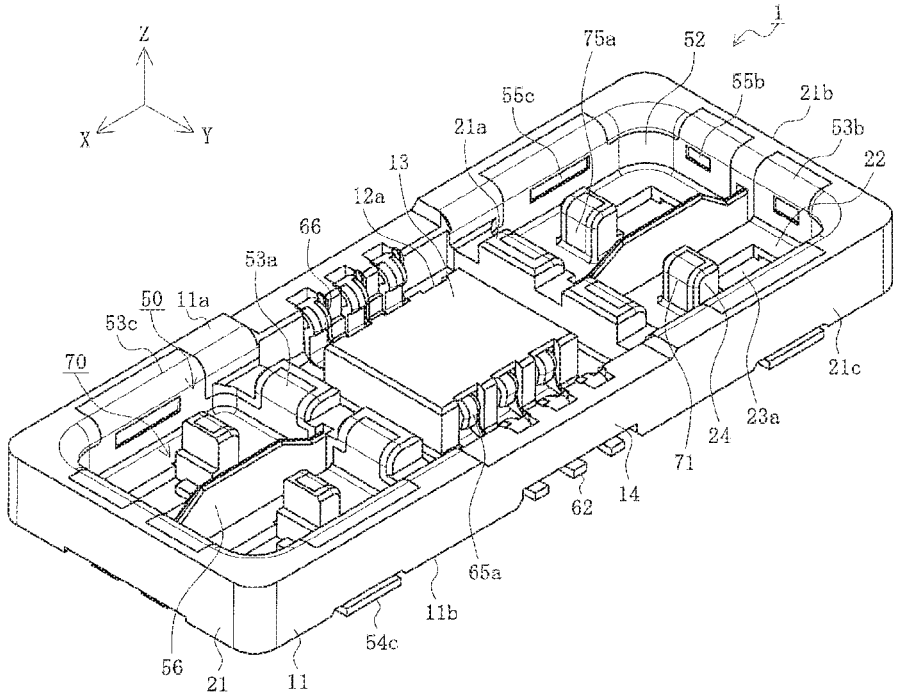
FIG. 3 is a perspective view of the first connector according to the present embodiment.
Figure 4:
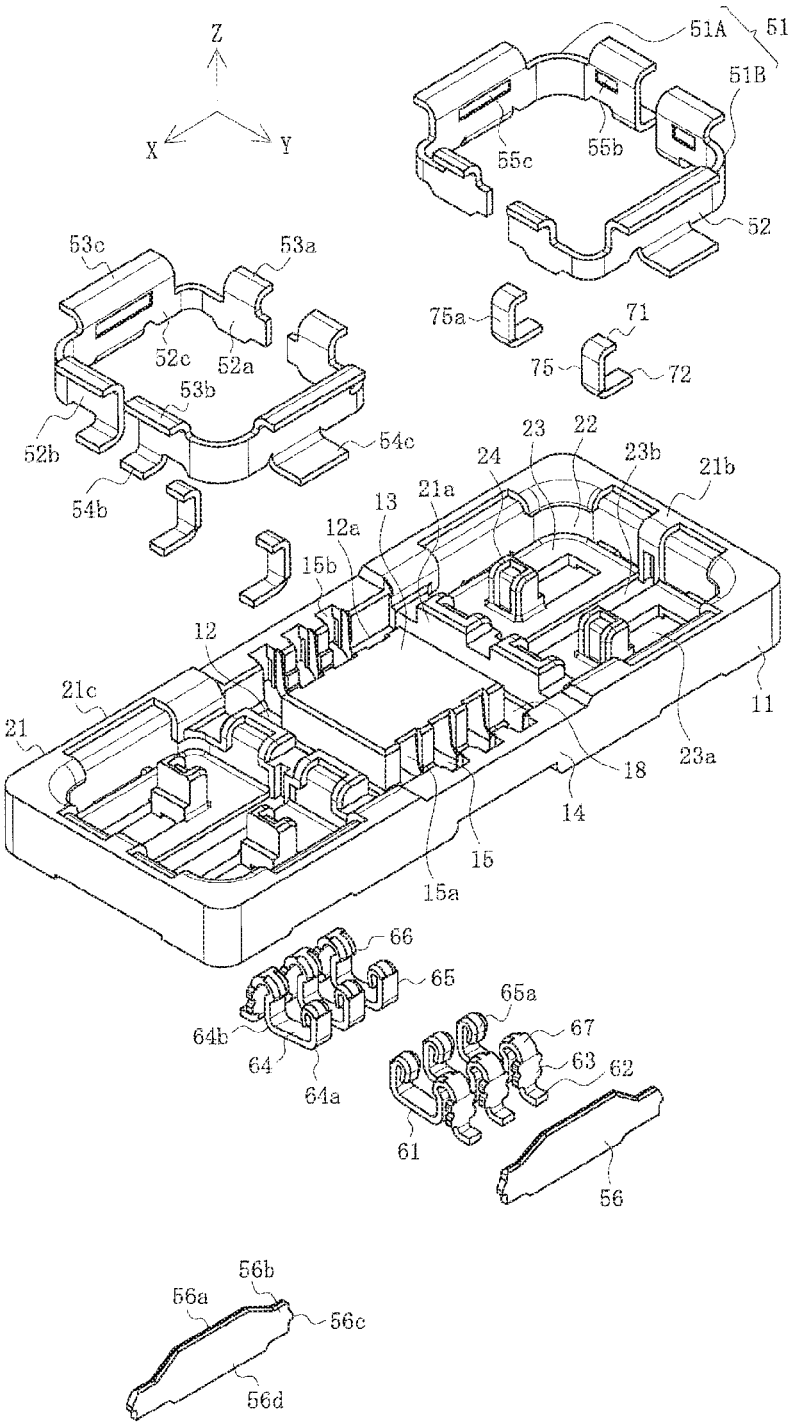
FIG. 4 is an exploded view of the first connector according to the present embodiment.

FIG. 1 is a perspective view of a state in which a first connector and a second connector according to the present embodiment are mated, FIG. 2 is a perspective view of the first connector according to the present embodiment before mating, FIG. 3 is a perspective view of the first connector according to the present embodiment, and FIG. 4 is an exploded view of the first connector according to the present embodiment.

In the figure, 1 is a connector of the present embodiment and is the first connector serving as one of a pair of board to board connectors serving as a connector assembly. The first connector 1 is a surface mount type connector mounted on the surface of a first substrate (not illustrated) serving as a mounting member and is mated to a second connector 101 serving as a counterpart connector. Furthermore, the second connector 101 is the other of the pair of board to board connectors and is a surface mount type connector mounted on the surface of a second substrate (not illustrated) serving as a mounting member.

Note that while the first connector 1 and the second connector 101 are ideally used for electrically connecting the first substrate and the second substrate serving as substrates, the connectors can also be used to electrically connect other members. Examples of the first substrate and the second substrate include printed circuit boards, flexible flat cables (FFC), flexible printed circuit boards (FPC), etc. used in electronic equipment, etc., but may be any type of substrate.

Furthermore, expressions indicating directions such as up, down, left, right, front, and back used to describe the operations and configurations of the parts of the first connector 1 and the second connector 101 in the present embodiment are not absolute but rather relative directions, and though appropriate when the parts of the first connector 1 and the second connector 101 are in the positions illustrated in the figures, these directions should be interpreted differently when these positions change in order to correspond to said change.

Furthermore, the first connector 1 has a first housing 11 as a first connector body integrally formed of an insulating material such as synthetic resin. As illustrated in the drawing, the first housing 11 is a substantially rectangular body having a substantially rectangular thick plate shape, wherein a first recess 12 that is a substantially rectangular recess enclosed around a periphery and mating with a second housing 111 of the second connector 101 is formed on the side in which the second connector 101 engages; in other words, on the mating surface 11*a* side (Z-axis positive direction side). In addition, a second recess 113 described below formed on the mating surface 111*a* side of a second housing 111 and a first projection 13 that mates as an inlet therewith are formed in the first recess 12 as one unit with the first housing 11.

Moreover, a first side wall part 14, which extends parallel to the first projection 13 on both sides (Y axis positive direction side and negative direction side) of this first projection 13 and sets both sides of the first recess 12 as side wall parts, is integrally formed with the first housing 11. In addition, the first projection 13 and the first side wall part 14 protrude upward from a bottom plate 18 defining the bottom face of the first recess 12 (Z axis positive direction) and extend in the longitudinal direction of the first housing 11. Consequently, a recessed groove 12*a* as an elongated recess which extends in the longitudinal direction of the first housing 11 as a portion of the first recess 12 is formed on both sides of the first projection 13.

Here, first terminal housing cavities 15 are formed from the side faces on both sides of the first projection 13 to the bottom face of the recessed groove 12*a*. In the illustrated example, the first terminal housing cavities 15 are formed so as to penetrate through the bottom plate 18 in the plate thickness direction (Z axis direction). Furthermore, of the first terminal housing cavities 15, the portions of the recessed groove parts formed on the side faces on both sides of the first projection 13 are referred to as first terminal housing inner cavity 15*a*, and the portions of the recessed groove parts formed on the corresponding side of the first projection 13 of the first side wall part 14 are referred to as first terminal housing outer cavity 15*b*.

In the present embodiment, a plurality (for example, three) of the first terminal housing cavities 15 are each formed at a predetermined pitch on both sides of each first projection 13 so as to form two rows in the longitudinal direction of the first housing 11. Note that the pitch and number of the first terminal hosing cavities 15 can be appropriately changed. In addition, a plurality of first terminals 61 as terminals which are housed in each of the first terminal housing cavities 15 and installed on the first housing 11 are disposed on both sides of each first projection 13 at the same pitch.

The first terminal 61 is a member which is formed integrally by performing machining such as punching and bending on a conductive metal plate, and includes: a held part 63, a tail part 62 connected to the lower end of the held part 63, an upper connection part 67 connected to the upper end of the held part 63, an outer contact part 66 which is connected to the lower end of the upper connection part 67 and faces the held part 63, a lower connection part 64 that is connected to the lower end of the outer contact part 66, and an inner connection part 65 connected to the end of the lower connection part 64 on the opposite side as the outer contact part 66.

Furthermore, the held part 63 is a member which extends in the vertical direction (z axis direction), that is, the thickness direction of the first housing 11, and is press fitted and held in the first terminal housing outer cavity 15*b*. In addition, the first terminal 61 is not necessarily attached to the first housing 11, and can be integrated with the first housing 11 by overmolding or insert molding. However, for convenience of description, a case where the held part 63 is held by inserting in the first terminal housing outer cavity 15*b* is described.

In addition, the tail part 62 is bent and connected to the held part 63 so as to extend outward in the left-right direction (Y-axis direction)—that is, the width direction of the first housing 11—and is connected to a connection pad coupled to a conductive trace of the first substrate by soldering or the like. Furthermore, the conductive trace is typically a signal line, however, the signal line is described as a line more for transmitting low frequency signals and not for transmitting high-frequency signals.

Further, the upper connection part 67 is a portion which is curved approximately 180 degrees so as to project upward (Z-axis positive direction). An outer contact part 66 which extends downward (negative z axis direction) is connected to the lower end of the upper connection part 67 on the opposite side as the held part 63. A portion of the outer contact part 66 preferably projects inward in the width direction of the first housing 11.

In addition, the lower connection part 64 is a member having a substantially U-shaped side surface shape connected to the lower end of the outer contact part 66. In the lower connection part 64, the portion connected to the lower end of the outer contact part 66 is a lower outside curved part 64*b*, and the portion connected to the lower end of the inner connection part 65 is a lower inside curved part 64*a*. Furthermore, an inner contact part 65*a* which is curved approximately 180 degrees so as to project upward and toward the outer contact part 66 is connected to the upper end of the inner connection part 65.

The first terminal 61 is press fitted into the first terminal housing cavity 15 from the mounting surface 11*b*, which is the lower surface (surface of the negative z axis direction) of the first housing 11, and the held part 63 is held from both sides by the side walls of the first terminal housing outer cavity 15*b* formed on the side surface inside the first side wall part 14 so as to be secured to the first housing 11. Here, or in other words in a state in which the first terminal 61 is mounted on the first housing 11, the inner contact part 65*a* and outer contact part 66 are positioned on both the left and right sides of the recessed groove part 12*a* so as to face one another. In addition, when viewed from the longitudinal direction (x axis direction) of the first housing 11, most of the held part 63 is housed inside the first terminal housing outer cavity 15*b*, and most of the inner contact part 65*a* is housed inside the first terminal housing inner cavity 15*a*.

Note that the first terminal 61 is a member which is integrally formed by processing a metal plate and therefore has a certain degree of elasticity. As is clear from this shape, the spacing between the inner contact part 65*a* and the outer contact part 66 is elastically changeable. In other words, when the second terminal 161 provided on the second connector 101 is inserted between the inner contact part 65*a* and the outer contact part 66, this causes the spacing between the inner contact part 65*a* and the outer contact part 66 to be elongated elastically.

Moreover, each first protruding end part 21 as a mating guide part is disposed on both ends in the longitudinal direction of first housing 11. A mating recess 22 adjacent to the first recess 12 is formed on each first protruding end part 21. The mating recess 22 is a substantially rectangular recess connected to both ends in the longitudinal direction of each recessed groove 12*a*. Additionally, in the state in which the first connector 1 and the second connector 101 are mated, a second protruding end part 122 contained in second connector 101 is inserted into the mating recess 22.

Further, the first protruding end part 21 includes: as a sidewall, a first side wall extension 21*c* as a mating guide side wall part extending in the longitudinal direction of the first housing 11 from both ends in the longitudinal direction of the first side wall part 14, and a first partitioning wall 21*a* and a first end wall 21*b* extending in the width direction of the first housing 11 with both ends thereof connected to the first sidewall extension 21*c*. The first partitioning wall 21*a* is connected to the first sidewall extension 21*c* on the boundary of the first side wall part 14 and the first sidewall extension 21*c*, and functions as a partitioning wall for the first recess 12 and the mating recess 22. In addition, the first end wall 21*b* is connected with the first sidewall extension 21*c* on both ends of the first housing 11 in the longitudinal direction.

For each of the first protruding end parts 21, the first partitioning wall 21*a*, the first end wall 21*b*, and the first sidewall extension 21*c* connected to both ends thereof form a continuous substantially box-shaped side wall as viewed in plan view and define four sides of the substantially rectangular mating recess 22. In addition, the bottom surface of the mating recess 22 is roughly covered by a protruding end bottom plate 23 which is the bottom plate. However, a first high-frequency terminal hold part 24 that protrudes upward, and a protruding end opening 23*a* and protruding end center groove 23*b* that penetrate the protruding end bottom plate 23 in the plate thickness direction (z axis direction) are formed on the protruding end bottom plate 23.

The protruding end center groove 23*b* is a long and narrow slit shaped groove that extends in the longitudinal direction (x axis direction) of the first side wall part 14 in the center of the width direction (y axis direction) of the mating recess 22, and separates the mating recess 22 in the width direction, or in other words, to the left and right thereof. Therefore, the first high-frequency terminal supporting part 24 is formed near the center in the width direction of the respective right and left halves of the mating recess 22, and a substantially rectangular protruding end opening 23*a* is formed on both ends of the first high-frequency terminal hold part 24 in the longitudinal direction. Each of the first high-frequency terminal hold part 24 have a first high-frequency terminal 71 attached thereto, and each of the first protruding end parts 21 have a first shielding member 51 attached thereto that electromagnetically shields around the first high-frequency terminal 71.

The first high-frequency terminal 71 is a member integrally formed by carrying out processes such as punching and bending a conductive metal plate and includes a first connecting part 75 as well as a first tail part 72 connected to the first connecting part 75. In addition, the first high-frequency terminal 71 is integrated with the first housing 11 by overmolding or insert molding That is, the first housing 11 is molded by filling the cavity of a mold, in which the first high-frequency terminal 71 has been set beforehand, with an insulating material such as synthetic resin. As a result, the first connecting part 75 is integrally attached to the first housing 11, so that at least a portion is embedded in the first housing 11. Furthermore, the first high-frequency terminal 71 is not necessarily integrated with the first housing 11 by overmolding or insert molding and may be attached to the first housing 11 by press fitting, or the like. Herein, for convenience of description, a case of integration with the first housing 11 by overmolding or insert molding will be described.

The first connecting part 75 is a member substantially having a U-shape when viewed from the side, wherein the part extending in the front and rear direction (x axis direction) is connected to both the upper and lower ends of the part which extends in the vertical direction (z axis direction), and at least a portion of the inward surface in the longitudinal direction of the first housing 11 is exposed to the side facing the inner longitudinal direction of the first housing 11 of the first high-frequency terminal hold part 24, and is connected with a first contact part 75*a* that is the connecting part. This first contact part 75*a* sits roughly along the same plane as a side surface of the first high-frequency terminal hold part 24, and is a part that contacts the second high-frequency terminal 171 provided on the second connector 101. Moreover, the first tail part 72 is exposed within the protruding end opening 23*a* by extending outward in the longitudinal direction of the first housing 11, from the tip portion which extends in the width direction on the lower side of the first connecting part 75, and is connected to a connection pad coupled to a conductive trace of the first substrate by soldering or the like. Note that the conductive trace is typically a signal line, and conveys a high frequency signal.

In addition, the first shielding member 51 is a member integrally formed by carrying out processes such as punching and bending a conductive metal plate, and includes a first right shielding part 51A and a first left shielding part 51B corresponding respectively to the right and left halves of the mating recess 22. However, the first right shielding part 51A and the first left shielding part 51B have mutually opposite shapes relative to the x-z plane passing through a center in the width direction of the mating recess 22. Herein, the first right shielding part 51A and the first left shielding part 51B are described as a first shielding member 51.

In a planar view, the first shielding member 51 has a substantially U-shaped first side plate part 52. The first side plate part 52 includes a first partitioning wall shielding part 52*a* attached to the first partitioning wall 21*a*, a first end wall shielding part 52*b* affixed on the first end wall 21*b*, and a first sidewall extension shielding part 52*c* attached on the first sidewall extension 21*c*. In addition, a first partitioning wall covering part 53*a* is integrally connected on the top end of the first partitioning wall shielding part 52*a* as a mating surface cover part, a first end wall covering part 53*b* is integrally connected on the top end of the first end wall shielding part 52*b* as a mating surface cover part, and a first sidewall extension covering part 53*c* is integrally connected on the top end of the first sidewall extension shielding part 52*c* as a mating surface cover. The first partitioning wall covering part 53*a*, first end wall covering part 53*b*, and the first sidewall extension covering part 53*c* are connected to the top ends of the first partitioning wall shielding part 52*a*, first end wall shielding part 52*b*, and first sidewall extension shielding part 52*c* at a 90 degree angle, and cover at least a portion of the surface of the first partitioning wall 21*a*, first end wall 21*b*, and first sidewall extension 21*c* respectively on the mating surface 11*a* side.

In addition, the first shielding member 51 is integrated with the first housing 11 by overmolding or insert molding. In other words, the first housing 11 is molded by filling the cavity of a mold, in which the first shielding member 51 has been set beforehand, with an insulating material such as synthetic resin. As a result, the first shielding member 51 is integrally attached to the first housing 11, so that at least a portion is embedded in the first housing 11. Note that the first shielding member 51 is not necessarily integrated with the first housing 11 by overmolding or insert molding and may be attached to the first housing 11 by press fitting, or the like. Herein, for convenience of description, a case of integration with the first housing 11 by overmolding or insert molding will be described.

Moreover, at bottom ends of the first end wall shielding part 52*b* and the first sidewall extension shielding part 52*c*, a first end wall tail part 54*b* and a first sidewall extension tail part 54*c* are connected with a bend of approximately 90 degrees. The first end wall tail part 54*b* extends in the longitudinal direction, or more specifically in the outer direction of the longitudinal direction of the first housing 11, and is connected by soldering or the like to a connection pad linked with a conductive trace of the first substrate. In addition, the first sidewall extension tail part 54*c* extends in the left and right direction, or more specifically in the outer direction of the width direction of the first housing 11 and is connected by soldering or the like to a connection pad linked with a conductive trace of the first substrate. Note that the conductive trace is a ground line, which is a ground line disposed alongside the signal line that conveys a high frequency signal functioning to electrically shield the signal line. In addition, the tail part is not connected to the bottom end of the first partitioning wall shielding part 52*a* in the example shown in the figure, however, the same tail part for the first end wall tail part 54*b* and the first sidewall extension tail part 54*c* can be connected as necessary.

Moreover, the inner surfaces of the first end wall shielding part 52*b* and the first sidewall extension shielding part 52*c* are formed such that a first end wall shielding recessed part 55*b* and a first sidewall extension shielding recessed part 55*c* can be recessed. The first end wall shielding recessed part 55*b* and the first sidewall extension shielding recessed part 55*c* are parts that join with a mating recessed part second end wall shielding protruding part 155*b* formed on a second shielding member 151 of the second connector 101 and a second sidewall extension shielding protruding part 155*c* when the first connector 1 and the second connector 101 are mated. Furthermore, a mating recessed part is not formed on the inner surface of the first partitioning wall shielding part 52*a* in the example shown in the figure, however, the same mating recessed part as the first end wall shielding recessed part 55*b* and the first sidewall extension shielding recessed part 55*c* can be formed as necessary.

In addition, a first center shielding member 56 is held in the protruding end center groove 23*b* as a shielding plate that extends in the thickness direction (z axis direction) and the longitudinal direction of the first housing 11, formed by processing (such as punching and the like) of a conductive metal plate. This first center shielding member 56 is a long and narrow belt-shaped plate material that works together with the first shielding member 51 to configure a square tube shaped first high-frequency shield 50 with a substantially rectangular cross-section, and includes an upward protruding part 56*a* that protrudes upward, a downward protruding part 56*d* that corresponds to the upward protruding part 56*a* and protrudes downward, an edge part 56*b* formed on both ends in the longitudinal direction, and a mating protrusion 56*c* that protrudes from the edge part 56*b*.

Furthermore, when the first center shielding member 56 is inserted and press fitted in the protruding end center groove 23*b* on the bottom surface of the protruding end bottom plate 23, or in other words the mounting surface 11*b* side, both ends of the protruding end center groove 23*b* in the longitudinal direction protrude into the edge part 56*b*, and the mating protrusion 56*c* penetrates into and mates with both ends of the protruding end center groove 23*b* in the longitudinal direction. Therefore, the first center shielding member 56 is stowed in the protruding end center groove 23*b* and is held. Furthermore, the first central shielding member 56 is not necessarily integrated with the first housing 11 by insertion or press fitting and may be attached to the first housing 11 by overmolding or insert molding. However, for convenience of description, a case where the first center shielding member 56 is held by the protruding end center groove 23*b* by insertion or press fitting will be described herein. Moreover, in the example shown in the figures, the first center shielding member 56 does not directly contact the first shielding member 51. However, when the first connector 1 and the second connector 101 are mated together, the first central shielding member 56 and the first shielding member 51 conduct electricity and reach the same electric potential through contact with the second shielding member 151 of the second connector 101. Furthermore, the first center shielding member 56 and the first shielding member 51 can make direct contact as necessary.

In this manner, as there is the first center shielding member 56 in between the first right shielding part 51A and the first left shielding part 51B, each right and left halves of the mating recessed parts 22 make up the first high-frequency shield 50 with a substantially rectangular cross-section, which is shaped as a square tube that provides an electromagnetic shield and extends in the mating direction (z axis direction) surrounding a first high-frequency terminal 71. In addition, a first high-frequency connection unit 70 is configured to include one of the first high-frequency terminals 71 and one of the first high-frequency shields 50. This first high-frequency connection unit 70 can exhibit a shielding effect equivalent to a conventional coaxial type connector, while having a miniature low profile, can transmit a high frequency signal, and a plurality can be disposed without gaps in the first protruding end part 21 which has a substantially rectangular shape in a planar view, because the profile is substantially rectangular in a planar view. Therefore, as shown in the example in the drawing, each first high-frequency connection unit 70 can be arranged proximal to the extension line of each row of the first terminals 61 that are arranged in the longitudinal direction of the first housing 11. Furthermore, while there are two first high-frequency connection units 70 arranged in the width direction of the first housing 11 for each of the first protruding end parts 21, three or more can be arranged as necessary, and in addition, two or more can also be arranged in the longitudinal direction of the first housing 11.

Furthermore, the first shielding member 51 is a member that is formed integrally by carrying out processes such as punching and bending a metal plate, and when in a state attached to the first housing 11, the first partitioning wall shielding part 52*a*, first end wall shielding part 52*b*, and first sidewall extension shielding part 52*c* cover a majority of the inner surface of the first partitioning wall 21*a*, first end wall 21*b*, and the first sidewall extension 21*c*, and the first partitioning wall covering part 53*a*, first end wall covering part 53*b*, and first sidewall extension covering part 53*c* cover at least a portion of the mating surface 11*a* side surface of the first partitioning wall 21*a*, the first end wall 21*b*, and the first sidewall extension 21*c*, functioning as a reinforcing fitting that reinforces the entire first protruding end part 21 and the first connector 1. In addition, because the first end wall tail part 54*b* and the first sidewall extension tail part 54*c* that are connected to the bottom end of the first end wall shielding part 52*b* and the first sidewall extension shielding part 52*c* are connected by soldering or the like to connection pads linked to a grounding line of the first substrate, the first shielding member 51 does not easily deform, and the first protruding end part 21 and the first connector 1 are effectively reinforced.

Next, the configuration of the second connector 101 will be described.

Figure 5:
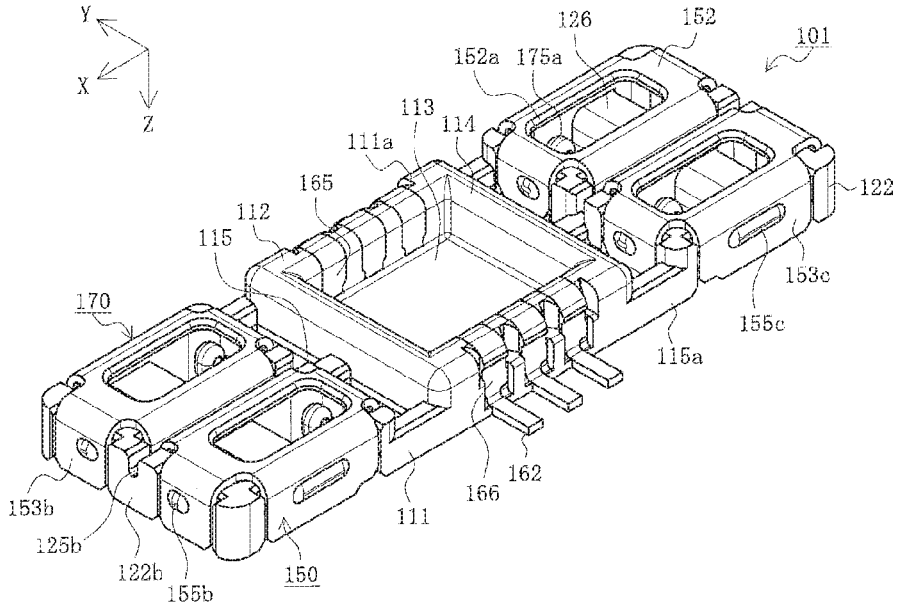
FIG. 5 is a perspective view of the second connector according to the present embodiment.
Figure 6:
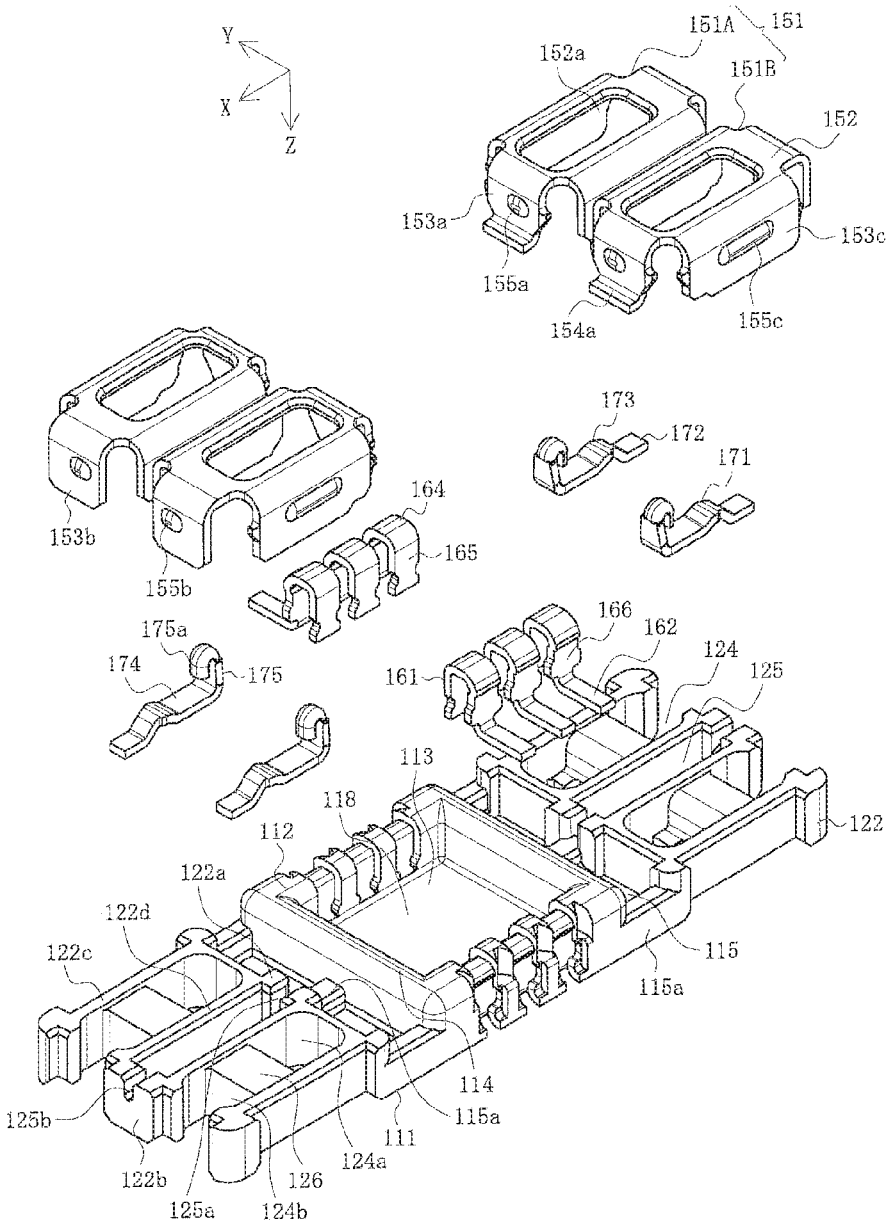
FIG. 6 is an exploded view of the second connector according to the present embodiment.
Figure 7:
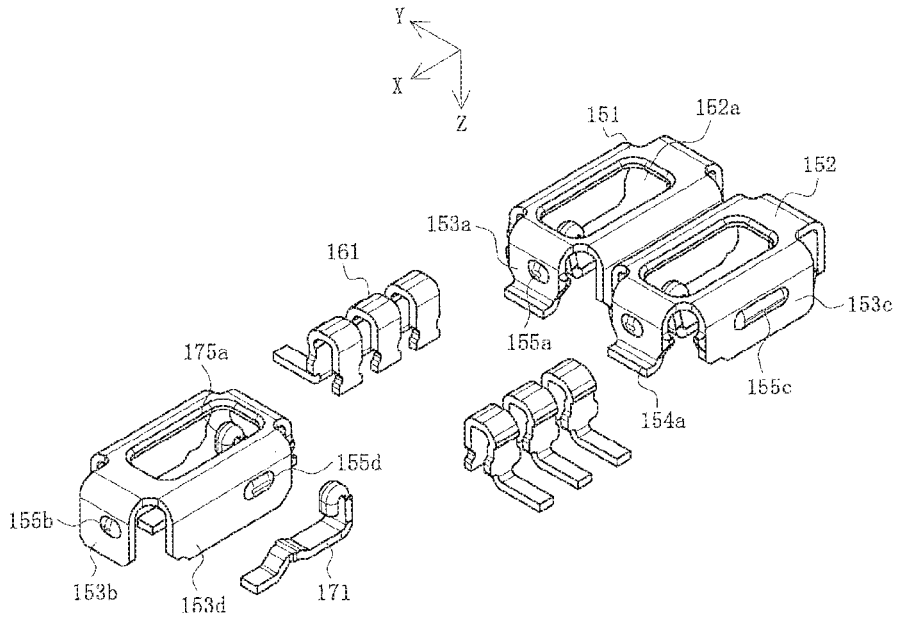
FIG. 7 is a perspective view showing the metal member arrangement of the second connector according to the present embodiment.

FIG. 5 is a perspective view of the second connector of the present embodiment, FIG. 6 is an exploded view of the second connector of the present embodiment, and FIG. 7 is a perspective view of the metal components of the second connector of the present embodiment.

The second connector 101 as a counterpart connector according to the present embodiment has the second housing 111 as a second connector body that is a counterpart connector body integrally formed of an insulating material such as synthetic resin. As illustrated in the figure, this second housing 111 is a substantially rectangular body with the shape of a substantially rectangular thick plate. In addition, there is a substantially rectangular recessed part enclosed therearound on the side where the first connector 1 of the second housing 111 is inserted, or in other words on the mating surface 111*a* (negative z axis direction) side, where there is the second recess 113 that mates with the first projection 13 of the first housing 11 of the first connector 1. Moreover, a second sidewall part 112 that extends in the longitudinal direction (z axis direction) of the second housing 111 on both sides (positive and negative y axis direction) of the second recessed part 113 set up as both sides of the second recess 113 as a sidewall part is formed integrally with the second housing 111. Furthermore, at the front and rear (positive and negative directions on X axis) of the second recess 113, a second horizontal wall part 114 that extends in the width direction (y axis direction) of the second housing 111, has both ends connected to the second sidewall part 112, and defines the horizontal wall parts of the front and rear of the second recess 113 is formed integrally with the second housing 111. Moreover, the second sidewall part 112 and the second horizontal wall part 114 protrude upward (negative z axis direction) from a bottom plate 118 of the second housing 111 set up as the bottom surface of the second recess 113.

In addition, each of the second sidewall parts 112 is provided with a second terminal 161 as an opposite terminal. The second terminal 161 is disposed at a pitch corresponding to the first terminal 61 and in a number corresponding thereto.

The second terminal 161 is a member which is formed integrally by performing machining such as punching and bending on a conductive metal plate, and includes: an inner contact part 165, a connecting part 164 connected to the upper end of the inner contact part 165, an outer contact part 166 connected to the outer end of the connecting part 164, and a tail part 162 connected to the lower end of the outer contact part 166. In addition, the second terminal 161 is integrated with the second housing 111 by overmolding or insert molding. That is, the second housing 111 is molded by filling the cavity of a mold, in which the second terminal 161 has been set beforehand, with an insulating material such as synthetic resin.

Thus, at least a portion of the second terminal 161 is embedded in the second housing 111 and is integrally attached to the second housing 111. In addition, the surfaces of the inner contact part 165, connecting part 164, and the outer contact part 166 are exposed to each side surface of the second sidewall part 112 and the mating surface 111*a*. In addition, the tail part 162 extends outward in the width direction from the second sidewall part 112 to the second housing 111, and is connected to a connection pad linked to a conductive trace of the second substrate. Furthermore, the conductive trace is typically a signal line, however, the signal line is described as a line for transmitting lower frequency signals and not for transmitting high-frequency signals.

Note that the second terminal 161 is not necessarily integrated with the second housing 111 by overmolding or insert molding and may be attached to the second housing 111 by press fitting, etc., wherein, for convenience of description, the case of the integration with the second housing 111 by overmolding or insert molding will be described.

Moreover, each second protruding end part 122 as a counterpart mating guide part is disposed on both ends in the longitudinal direction of the second housing 111. The second protruding end parts 122, in a state in which the first connector 1 and the second connector 101 are mated, function as insertion protrusions to be inserted into the mating recess parts 22 of the first protruding end parts 21 provided on the first connector 1. Furthermore, each second protruding end part 122 is arranged separately from the longitudinal direction from the second horizontal wall part 114 to the second housing 111 such that a void part 115 is formed between the second horizontal wall part 114 therewith, and is connected to the second horizontal wall part 114 with a plurality (three in the example shown in the drawing) of connecting beams 115*a*.

Furthermore, the second protruding end part 122 provides a second sidewall extending part 122*c* that is the sidewall part of the second protruding end part 122 that extends in the longitudinal direction of the second housing 111, and a second partitioning wall part 122*a* and a second end wall part 122*b* that extend in the width direction of the second housing 111 and are connected at both ends to the second sidewall extending part 122*c*. The second partitioning wall part 122*a* is connected to the second sidewall extending part 122*c* on the void part 115 side, and is configured as a partitioning wall of the second protruding end part 122 and the void part 115. In addition, the second end wall part 122*b* is connected with the second sidewall extending part 122*c* on the longitudinal direction side of the second housing 111. Furthermore, the second sidewall extending part 122*c* is connected to the second sidewall part 112 through the connecting beams 115*a* that are positioned on the outer width direction of the second housing 111, the outer surface of which is flush with the outer surface of the connecting beam 115*a* and the second sidewall part 112 that are placed along the outer width direction of the second housing 111.

With regards to the second protruding end part 122, there are two second high-frequency terminal receiving recessed parts 124 arranged in the width direction of the second housing 111 and a center recessed part 125 is formed in between the two second high-frequency terminal receiving recessed parts 124. In addition, the second high-frequency terminal receiving recessed part 124 and the center recessed part 125 are separated by a second center wall part 122*d* that is parallel to the second sidewall extending part 122*c*. Both ends of the second center wall part 122*d* are connected to the second partitioning wall part 122*a* and the second end wall part 122*b*. The second high-frequency terminal receiving recessed part 124 and the center recessed part 125 are through holes that pass through the second protruding end part 122 in the plate thickness direction (z axis direction).

Furthermore, a beam-shaped second high-frequency terminal supporting part 126 is arranged in each of the second high-frequency terminal receiving recessed parts 124 that extends in the width direction of the second housing 111 and of which both ends are connected to the second sidewall extending part 122*c* and the second center wall part 122*d*. In addition, each of the second high-frequency terminal receiving recessed parts 124 are divided into a center side recessed part 124*a* and an end side recessed part 124*b* by the second high-frequency terminal supporting part 126. Furthermore, the example shown in the drawing lacks a part corresponding to the end side recessed part 124*b* of the second end wall part 122*b* and the end side recessed part 124*b* is opened in the longitudinal direction end part of the second housing 111, however, this is not a limitation, such that the second end wall part 122*b* can continue and the end side recessed part 124*b* can be closed in the longitudinal direction end part of the second housing 111.

In addition, a center notch part 125*a* and an end notch part 125*b* that pass through the center recessed part 125 are formed on the part corresponding to the second partitioning wall part 122*a* and the center recessed part 125 of the second end wall part 122*b*. When the first connector 1 and the second connector 101 are mated, the parts in the vicinity of both ends of the upward protruding part 56*a* of the first center shielding member 56 of the first connector 1 are received by the center notch part 125*a* and the end notch part 125*b*.

Additionally, each of the second high-frequency terminal supporting parts 126 has a second high-frequency terminal 171 attached thereto, and each second high-frequency terminal receiving recessed part 124 has a second shielding member 151 attached thereto, configuring a second high-frequency shield 150 shield having a rectangular cylinder shape with a substantially rectangular cross section extending in the mating direction enclosing around the second high-frequency terminals 171.

Each of the second high-frequency terminals 171 is a member integrally formed by carrying out processes such as punching and bending a conductive metal plate, and includes a second held part 173 being held by the second high-frequency terminal supporting part 126, a second tail part 172 connected to one end of the second held part 173, a second connecting part 174 connected to the other end of the second held part 173, a second contact arm 175 connected to the end of the second connecting part 174, and a second contact part 175*a* that is formed on the end of the second contact part 175, or in other words on the free end, and is a contact part.

In addition, the second high-frequency terminal 171 is integrated with the second housing 111 through overmolding or insert molding. In other words, the second housing 111 is molded by filling the cavity of a mold, in which the second high-frequency terminal 171 has been set beforehand, with an insulating material such as synthetic resin. As a result, the second high-frequency terminal 171 is integrally attached to the second high-frequency terminal supporting part 126, so that at least the second held part 173 is embedded in the second high-frequency terminal supporting part 126. Furthermore, the second high-frequency terminal 171 is not necessarily integrated with the second housing 111 by overmolding or insert molding and may be attached to the second housing 111 by press fitting, or the like. Herein, for convenience of description, the case of the integration with the second housing 111 by overmolding or insert molding will be described.

The second held part 173 generally extends in the width direction of the second housing 111, and is bent so as to expand upward, thereby being embedded and held in the second high-frequency terminal supporting part 126. Moreover, the second tail part 172 is exposed inside the end side recessed part 124*b* by extending outward in the longitudinal direction of the second housing 111 from one end of the second held part 173, and is connected to a connection pad coupled to a conductive trace of the second substrate by soldering or the like. Note that the conductive trace is typically a signal line, and conveys a high frequency signal.

Furthermore, the second connecting part 174 is exposed inward in the longitudinal direction of the second housing 111 from the other end of the second held part 173, and is exposed in the center side recessed part 124*a*. In addition, the second contact arm 175 extends inside the center side recessed part 124*a* upward from the end of the second connecting part 174, and is bent at approximately 180 degrees to form a U shape near the top end thereof, forming a second contact part 175*a* that bulges outward in the longitudinal direction of the second housing 111.

Furthermore, the second high-frequency terminal 171 is integrally formed by forming a metal plate and therefore has a certain degree of elasticity. In addition, as is clear from the shape, the second connecting part 174, the second contact arm 175, and the second contact part 175*a* can be elastically deformed. Accordingly, if a first high-frequency terminal hold part 24 of the first connector 1 with a first high-frequency terminal 71 attached thereto is inserted into the center side recessed part 124*a*, the second contact part 175*a* in contact with the first contact part 75*a* of the first high-frequency terminal 71 is elastically displaced inward in the longitudinal direction of the second housing 111.

In addition, the second shielding member 151 is a member integrally formed by performing processes such as punching and bending a conductive metal plate, and includes a second shield right member 151A and a second shield left member 151B that correspond to the second high-frequency terminal receiving recessed parts 124 of the right and left halves of the second protruding end part 122 respectively. However, the second shield right member 151A and the second shield left member 151B have shapes that are symmetrical in the x-z plane that goes through the center in the width direction of the second protruding end part 122. Herein, the second shield right member 151A and the second shield left member 151B are described as second shielding members 151 when described together.

In a planar view, the second shielding member 151 has a substantially box shaped second cover part 152. The second cover part 152 is a flat plate shaped member having a substantially rectangular profile in a planar view, and a cover opening 152*a* with a substantially rectangular shape is formed in the center thereof. In addition, the four edges of the second covering part 152 are integrally connected with a second partitioning wall shield part 153*a* attached to the second partitioning wall part 122*a*, a second end wall shield part 153*b* attached to the second end wall part 122*b*, a second sidewall extending shield part 153*c* attached to the second sidewall extending part 122*c*, and a second center wall shield part 153*d* attached to the second center wall part 122*d*. The second cover part 152 covers the greater part of the side of the mating surface 111*a* of the second partitioning wall part 122*a*, second end wall part 122*b*, second sidewall extending part 122*c*, and second center wall part 122*d*, and the second partitioning wall shield part 153*a*, second end wall shield part 153*b*, second sidewall extending shield part 153*c*, and the second center wall shield part 153*d* are connected to the edges of the second cover part 152 with a bend of approximately 90 degrees, of which each covers the greater part of the outer surfaces of the second partitioning wall part 122*a*, second end wall part 122*b*, second sidewall extending part 122*c*, and the second center wall part 122*d* respectively.

In addition, the second shielding member 151 is integrated with the second housing 111 by overmolding or insert molding. In other words, the second housing 111 is molded by filling the cavity of a mold, in which the second shielding member 151 has been set beforehand, with an insulating material such as synthetic resin. As a result, at least a portion of the second shielding member 151 is embedded in the second housing 111 so as to be integrally attached to the second housing 111. Furthermore, the second shielding member 151 is not necessarily integrated with the second housing 111 by overmolding or insert molding and may be attached to the second housing 111 by press fitting, or the like; however, for convenience of description, a case of the integration with the second housing 111 by overmolding or insert molding will be described.

In addition, a second partitioning wall tail part 154*a* is connected as a tail part to the bottom end of the second partitioning wall shield part 153*a* with a bend of approximately 90 degrees. The second partitioning wall tail part 154*a* extends inwards in the longitudinal direction of the second housing 111, and is connected to a connection pad linked to a conductive trace of the second substrate by soldering or the like. Note that the conductive trace is a ground line, which is a ground line disposed alongside the signal line that conveys a high frequency signal functioning to electrically shield the signal line. In addition, in the example shown in the drawing, a tail part is not connected to the bottom end of the second end wall shield part 153*b*, second sidewall extending shield part 153*c*, or second center wall shield part 153*d*; however, this can be connected to the same tail part for the second partitioning wall tail part 154*a* as necessary.

Furthermore, the outer surfaces of the second partitioning wall shield part 153*a*, second end wall shield part 153*b*, the second sidewall extending shield part 153*c*, and the second center wall shield part 153*d* are formed as such that a second partitioning wall shield protruding part 155*a*, second end wall shielding protruding part 155*b*, second sidewall extension shielding protruding part 155*c*, and second center wall shield protruding part 155*d* bulge out as mating protrusion parts. When the first connector 1 and the second connector 101 are mated, the second end wall shielding protruding part 155*b* and the second sidewall extension shielding protruding part 155*c* engage in the first end wall shielding recessed part 55*b* and the first sidewall extension shielding recessed part 55*c* which are mating recessed parts formed on the first shielding member 51 of the first connector 1. In addition, the second partitioning wall shield protruding part 155*a* presses on the inner surface of the first partitioning wall shielding part 52*a* of the first shielding member 51. Furthermore, the second center wall shield protruding part 155*d* presses on the side surface of the first center shielding member 56 that is inserted between the opposing second center wall shield parts 153*d*.

As the second shield right member 151A and the second shield left member 151B are attached on the periphery of each of the second high-frequency terminal receiving recessed parts 124 that stows the second high-frequency terminals 171, each of the right and left halves of the second protruding end parts 122 are made up of a second high-frequency connection unit 170 provided with one second high-frequency terminal 171 and a second high-frequency shield 150 with a rectangular cylinder electromagnetic shield that has a substantially rectangular cross-section surrounding the periphery thereof and extends in the mating direction (z axis direction) thereof. This second high-frequency connection unit 170 can exhibit a shielding effect equivalent to a conventional coaxial type connector, while having a miniature low profile, can transmit a high frequency signal, and a plurality can be disposed without gaps in the second protruding end part 122 which has a substantially rectangular shape in a planar view, because the profile is substantially rectangular in a planar view. Therefore, as shown in the example in the drawing, each second high-frequency connection unit 170 can be arranged proximal to the extension line of each row of the second terminals 161 that are arranged in the longitudinal direction of the second housing 111. Furthermore, in the example shown in the drawing, with regards to each second protruding end part 122, two of the second high-frequency connection units 170 are arranged in the longitudinal direction of the second housing 111; however, three or more can be arranged as necessary, and in addition, two or more can be arranged in the longitudinal direction of the second housing 111.

Furthermore, the second shielding member 151 is a member that is formed integrally by performing processes such as punching and bending a metal plate, and when in a state of being attached to the second housing 111, the second cover part 152 covers a greater part of the surface of the second partitioning wall part 122*a*, the second end wall part 122*b*, the second sidewall extending part 122*c*, and the mating surface 111*a* side of the second center wall part 122*d*, and the second partitioning wall shield part 153*a*, the second end wall shield part 153*b*, the second sidewall extending shield part 153*c*, and the second center wall shield part 153*d* cover the greater part of the outer surfaces of the second partitioning wall part 122*a*, the second end wall part 122*b*, the second sidewall extending part 122*c*, and the second center wall part 122*d*, functioning as a reinforcing fixture that reinforces the entire second protruding end part 122 and the second connector 101. In addition, as the second partitioning wall tail part 154*a* that is connected to the bottom end of the second partitioning wall shield part 153*a* is connected by soldering or the like to connection pads linked to the ground line of the second substrate, the second shielding member 151 deforms less readily, and the second protruding end part 122 and the second connector 101 are effectively reinforced.

The operation for mating the first connector 1 and the second connector 101 having the abovementioned configuration will be described next.

Figure 8A:
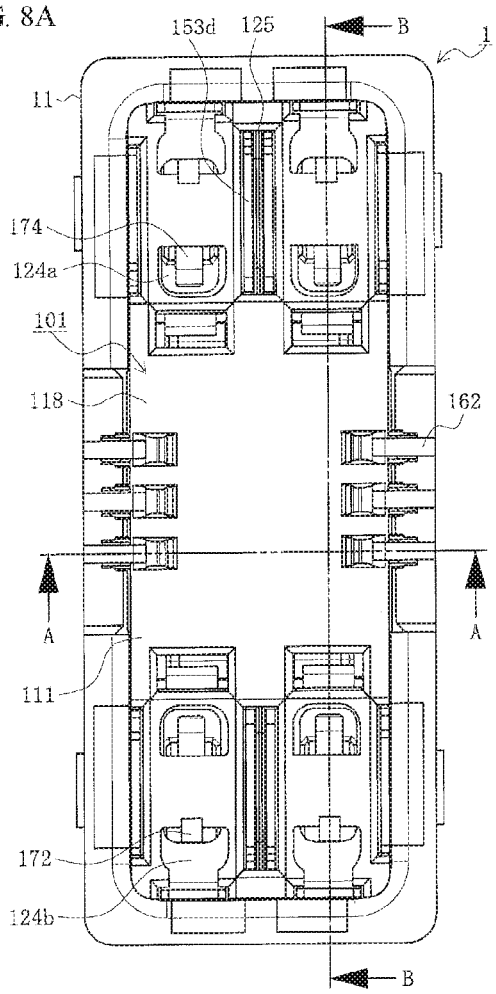
FIGS. 8A-8C are three plane views of the first connector of the present embodiment and second connector in a mated state where
Figure 8C:
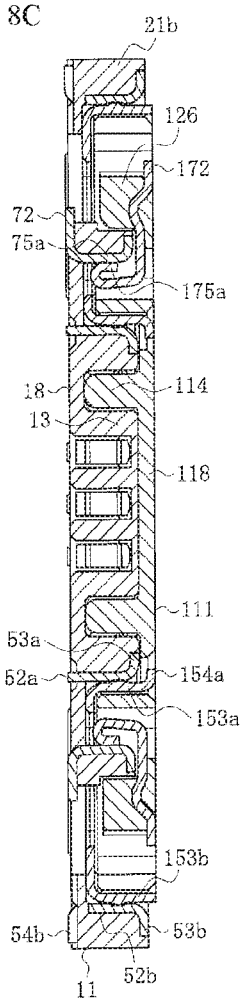
Figure 8B:
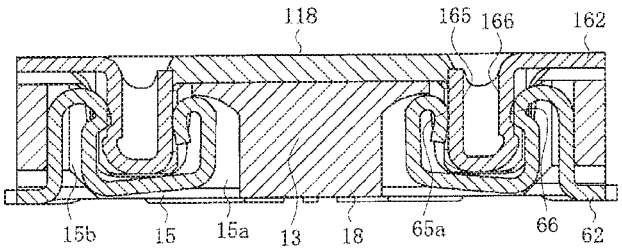
Figure 9A:
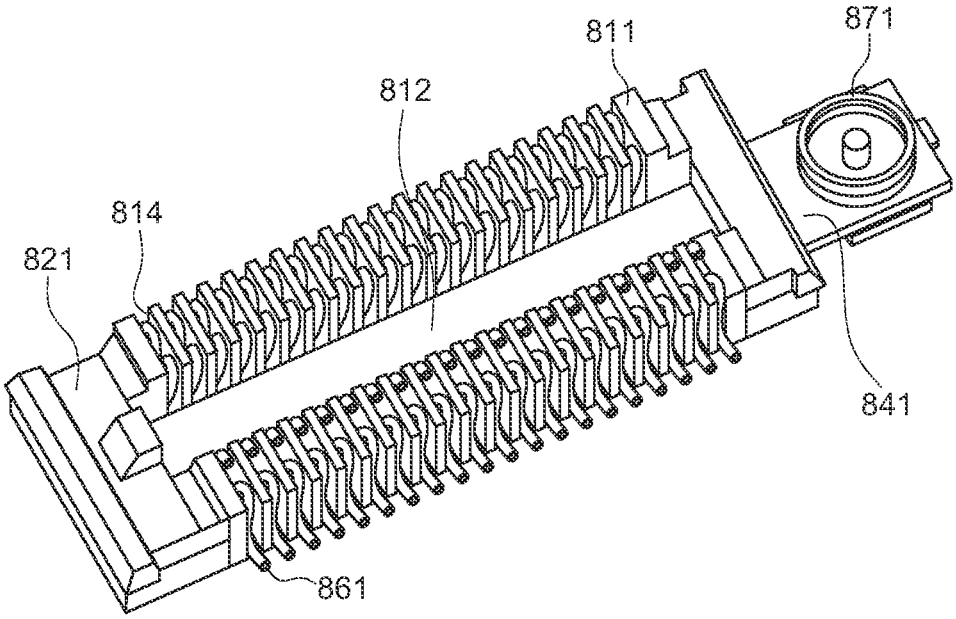
FIG. 9A (PRIOR ART)
FIGS. 9A and 9B are perspective views showing a conventional connector where
Figure 9B:
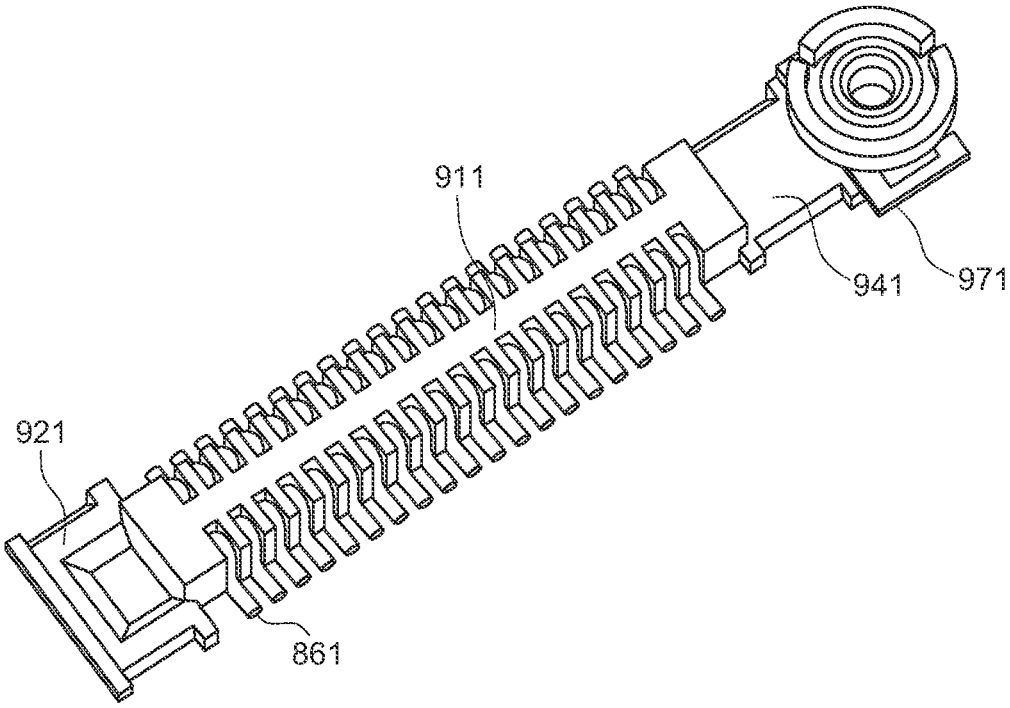
FIG. 9B (PRIOR ART)

FIGS. 8A-8C are three-sided views of the first connector and the second connector of the present embodiment in a mated state. Furthermore, in the drawing, FIG. 8A is a planar view of the first connector seen from above, FIG. 8B is a cross-sectional view along the A-A line of FIG. 8A, and FIG. 8C is a cross-sectional view along the B-B line of FIG. 8A.

Herein, the first connector 1 is mounted on the surface of the first substrate, as a connection is made to the first terminal 61, the tail part 62, the first tail part 72 of the first high-frequency terminal 71, as well as the first end wall tail part 54*b* of the first shielding member 51 and the first sidewall extension tail part 54*c* by soldering or the like to a connection pad linked to a conductive trace of the first substrate that is not shown in the drawing. In addition, the conductive trace linked to the connection pad to which the first tail part 72 of the first high-frequency terminal 71 is connected is a signal line, such as an antenna line connected to an antenna, which transmits a high frequency signal. The conductive trace linked to the first end wall tail part 54*b* and the first sidewall extension tail part 54*c* of the first shielding member 51 is a ground line disposed alongside the signal line transmitting the high frequency signal, and functions as an electromagnetic shield for the signal line. The conductive trace linked to the connection pad to which the tail part 62 of the first terminal 61 is connected is a signal line, which transmits signals of a lower frequency than the high-frequency signals.

In the same manner, the second connector 101 is surface mounted on the second substrate (not shown) by connecting the tail part 162 of the second terminal 161 and the second tail part 172 of the second high-frequency terminal 171 as well as the second partitioning wall tail part 154*a* of the second shielding member 151 by soldering or the like to a connection pad coupled to a conductive trace of the second substrate. In addition, the conductive trace linked to the connection pad to which the second tail part 172 of the second high-frequency terminal 171 is connected is a signal line, such as an antenna line connected to an antenna, which transmits a high frequency signal. The conductive trace linked to the second partitioning wall tail part 154*a* of the second shielding member 151 is a ground line arranged alongside the signal line transmitting high frequency signals and functioning as an electromagnetic shield for the signal line. The conductive trace linked to the connection pad to which the tail part 162 of the second terminal 161 is connected is a signal line, which transmits signals of a lower frequency than the high-frequency signals.

First, an operator places the mating surface 11*a* of the first housing 11 of the first connector 1 and the mating surface 111*a* of the second housing 111 of the second connector 101 in a state facing one another, and when the position of the first projection 13 of the first connector 1 is aligned with the position of the second recess 113 of the second connector 101 and the second protruding end part 122 of the second connector 101 is aligned with the position of the corresponding mating recess 22 of the first connector, the alignment of the first connector 1 and the second connector 101 is complete.

In this state, if the first connector 1 and/or the second connector 101 are moved in the direction approaching the other side, or in other words the mating direction, the first projection 13 of the first connector 1 is inserted into the second recess 113 of the second connector 101, and the second protruding end part 122 of the second connector 101 is inserted into the mating recess 22 of the first connector 1. Therefore, when mating of the first connector 1 and the second connector 101 is completed as shown in FIG. 1 and FIGS. 8A-8C, the first terminal 61 and the second terminal 161 conduct, placing the first high-frequency terminal 71 and the second high-frequency terminal 171 in a conductive state.

Specifically, the second terminal 161 of the second connector 101 is inserted between the inner contact part 65*a* and the outer contact part 66 of each first terminal 61, the inner contact part 65*a* of the first terminal 61 and the inner contact part 165 of the second terminal 161 come into contact, and the outer contact part 66 of the first terminal 61 and the outer contact part 166 of the second terminal 161 come into contact. Therefore, the mutually corresponding first terminal 61 and second terminal 161 come into contact in two locations, or enter into a so-called state of a plurality of contact points, and thus are able to maintain a conductive state even if one of the points is separated due to shock or vibration. Furthermore, the conductive traces linked to the connection pads on the first substrate to which the tail parts 62 of the first terminals 61 are connected become conductive with the conductive traces linked to the connection pads on the second substrate to which the tail parts 162 of the second terminals 161 are connected.

In addition, each first high-frequency terminal hold part 24 is inserted into the center side recessed part 124*a* of the corresponding second high-frequency terminal receiving recessed part 124, and the first contact part 75*a* of the first high-frequency terminal 71 and the second contact part 175*a* of the second high-frequency terminal 171 come into contact, resulting in conduction between the conductive trace linked to the connection pad on the first substrate to which the first tail part 72 of the first high-frequency terminal 71 is connected and the conductive trace linked to the connection pad on the second substrate to which the second tail part 172 of the second high-frequency terminal 171 is connected. Consequently, the first high-frequency terminal 71 and the second high-frequency terminal 171 which correspond to each other come into contact only at a single location, or a so-called state of a single contact point, rather than contacting at multiple locations, or a so-called state of multiple contact points, resulting in no unintentional stub or divided circuit being formed in a signal transmission line from the first tail part 72 of the first high-frequency terminal 71 to the second tail part 172 of the second high-frequency terminal 171, thereby stabilizing the impedance of the transmission line. Accordingly, also in the case of using the transmission line for transmitting high frequency signals, good SI (signal to interference) characteristics can be obtained.

Furthermore, the second protruding end part 122 is inserted in the mating recess 22, the second end wall shielding protruding part 155*b* of the second shielding member 151 and the second sidewall extension shielding protruding part 155*c* mates and connects with the first end wall shielding recessed part 55*b* and the first sidewall extension shielding recessed part 55*c* of the first shielding member 51, and the second partitioning wall shield protruding part 155*a* of the second shielding member 151 is pressed into and comes into contact with the first partitioning wall shielding part 52*a* of the first shielding member 51. In addition, the second center wall shield protruding part 155*d* of the second shielding member 151 is pressed against and makes contact with the side surface of the first center shielding member 56 that is inserted between the corresponding second center wall shield parts 153*d*. As a result, the conductive trace linked to the connection pad on the first substrate to which the first end wall tail part 54*b* and first sidewall extension tail part 54*c* of the first shielding member 51 are connected, and the conductive trace linked to the connection pad on the second substrate to which the second partitioning wall tail part 154*a* of the second shielding member 151 is connected become conductive with one another. Therefore, shielding is improved, with the ground line of the first substrate, the ground line of the second substrate, the first shielding member 51, the first center shielding member 56, and the second shielding member 151 all having the same electric potential.

Furthermore, as the second end wall shielding protruding part 155*b* and the second sidewall extension shielding protruding part 155*c* of the second shielding member 151 are mated with the first end wall shielding recessed part 55*b* and the first sidewall extension shielding recessed part 55*c* of the first shielding member 51, the first shielding member 51 and the second shielding member 151 are put into a locked state, preventing release of the mating state between the first connector 1 and the second connector 101.

In this manner, once the first connector 1 and the second connector 101 have mated, each of the first high-frequency connection units 70 is inserted into a corresponding second high-frequency connection unit 170, and the first high-frequency terminal 71 of each first high-frequency connection 70 unit comes into contact and conducts with the corresponding second high-frequency terminal 171 of the second high-frequency connection unit 170 at a single contact point. In addition, the second high-frequency shield 150 having a rectangular cylindrical shape with a substantially rectangular cross section and made up of the second shielding member 151 of the second high-frequency connection unit 170 is inserted within the first high-frequency shield 50 having a rectangular cylindrical shape with a substantially rectangular cross section as configured by the first side plate part 52 of the first shielding member 51 of the first high-frequency connection unit 70 and the first center shielding member 56. Therefore, the first high-frequency terminals 71 and the second high-frequency terminals 171 connected to each other are in a state of redundancy based on an electromagnetic shield with the periphery thereof extending in the mating direction and having a rectangular cylindrical shape with a substantially rectangular cross section, and good SI characteristics can be obtained even when using the transmission line for transmitting high frequency signals.

Note that, herein, the first high-frequency terminal 71 and the second high-frequency terminal 171 were described as being connected to a signal line for transmitting a high frequency signal. However, this signal line is not absolutely limited thereto, and may be used for transmitting a signal of any sort of frequency. In addition, the first terminals 61 and the second terminals 161 were described as signal line connectors that transmit low-frequency signals, however, "low-frequency" in the present disclosure is used with a relative meaning, signifying a lower frequency compared to the frequency of the high-frequency signals.

In this manner, in the present embodiment, the connector assembly includes: the first connector 1 which includes the first housing 11, the first terminals 61 installed in the first housing 11, and the first high-frequency connection unit 70, and the second connector 101 which includes the second housing 111, the second terminals 161 installed in the second housing 111, and the second high-frequency connection unit 170 installed in the second housing 111, and a second connector 101 that mates with the first connector 1. In addition, the first housing 11 includes the first recess 12 that is mated with the second housing 111 and the first protruding end part 21 that is formed on both ends in the longitudinal direction thereof with a mating recess 22 formed therein that has a substantially rectangular shape from a plan view and is installed with the first high-frequency connection unit 70. The first high-frequency connection unit 70 includes the first high-frequency terminal 71 and the first high-frequency shield 50 with a substantially rectangular cross section and a rectangular cylindrical shape that extends in the mating direction enclosing the vicinity of the first high-frequency terminal 71. The second housing 111 includes the second protruding end part 122 that has a shape that is substantially rectangular from a plan view, that is formed on both ends in the longitudinal direction thereof and is inserted in the mating recess 22, and is installed with the second high-frequency connection unit 170. The second high-frequency connection unit 170 includes the second high-frequency terminal 171 that makes contact with the first high-frequency terminal 71 and the second high-frequency shield 150 that has a substantially rectangular cross section and a rectangular cylindrical shape that extends in the mating direction enclosing the vicinity of the second high-frequency terminal 171 and is inserted in the first high-frequency shield 50.

Therefore, the first high-frequency connection unit 70 and the second high-frequency connection unit 170 can be installed with high space efficiency to the first connector 1 and the second connector 101, which are mounted on the first substrate and the second substrate with normal substantially rectangular shapes and demonstrate a high space efficiency. This not only allows for the connection of a plurality of high-frequency signal lines while also having a low profile, but also leads to a high shielding effect for the first high-frequency terminal 71 and the second high-frequency terminal 171, improving reliability.

In addition, a plurality of first high-frequency connection units 70 are arranged in the width direction of the first housing 11, and a plurality of second high-frequency connection units 170 are arranged in the width direction of the second housing 111. Therefore, a large number of high-frequency signal lines can be connected while maintaining high space efficiency.

Furthermore, the first high-frequency terminal 71 makes contact with the second high-frequency terminal 171 in only one location. Accordingly, the impedance is stabilized, and in the case of using the transmission line for transmitting high frequency signals, good SI characteristics can be obtained.

Furthermore, the first high-frequency shield 50 includes the first shielding members 51 that are installed on the first partitioning wall 21*a*, the first end wall 21*b*, and the first sidewall extension 21*c* of the first protruding end part 21, and the first center shielding member 56 that is installed on the protruding end bottom plate 23 that is the bottom plate of the mating recess 22 and extends in the longitudinal direction of the first housing 11. Moreover, the first center shielding member 56 is inserted in between the mutually adjacent second high-frequency shields 150 and makes contact with the second high-frequency shields 150. In addition, the second protruding end part 122 includes the second high-frequency terminal receiving recessed part 124 that stows the second high-frequency terminal 171, and the second high-frequency shield 150 is installed on the periphery of the second high-frequency terminal receiving recessed part 124. Therefore, while of a simple configuration, a high shield effect can be obtained for the first high-frequency terminal 71 and the second high-frequency terminal 171.

Note that the disclosure of the present specification describes characteristics related to a preferred and exemplary embodiment. Various other embodiments, modifications, and variations within the scope and spirit of the claims appended hereto could naturally be conceived of by persons skilled in the art by summarizing the disclosures of the present specification.

The present disclosure is applicable to a connector and a connector assembly.

The invention claimed is:

1. A first connector configured to mate with a second connector, the first connector comprising:

a first connector body, the first connector body comprises a first recess and a first mating guide part, the first mating guide part being formed on both ends of the first connector body in a longitudinal direction, the first mating guide part being formed with a first mating recess part;

a first terminal mounted on the first connector body; and a first high-frequency connection unit mounted on the first connector body, the first high-frequency connection unit being formed in a substantially rectangular shape from a plan view, the first high-frequency connection unit comprises a first high-frequency terminal and a first high-frequency shield, the first high-frequency shield having a square tube shape with a substantially rectangular cross-section, the first high-frequency shield extending in a mating direction to enclose around a periphery of the first high-frequency terminal, wherein the recess of the first connector body is configured to mate with a second connector body of the second connector, wherein the first high-frequency connection unit is mounted in the first mating recess part, and wherein the first mating recess part is configured to have a second mating guide part of the second connector body inserted therein.

2. The first connector according to claim 1, wherein a plurality of the first high-frequency connection units are mounted on the first connector body, wherein the plurality of the first high-frequency connection units are arranged in a width direction of the first connector body.

3. The first connector according to claim 1, wherein the first high-frequency shield comprises a first shield provided on a wall of the first mating recess part and a shield plate provided on a bottom plate of the first mating recess part, the shield plate extending in the longitudinal direction of the first connector body.

4. The second connector according to claim 1, wherein a plurality of the second high-frequency connection units are mounted on the second connector body, wherein the plurality of the second high-frequency connection units are arranged in a width direction of the second connector body.

5. The second connector according to claim 1, wherein the second high-frequency terminal is configured to be connected in one location to the first high-frequency terminal.

6. The second connector according to claim 1, wherein, the second mating guide part comprises a second high-frequency terminal stowage recess part that stows the second high-frequency terminal and the second high-frequency shield is attached enclosing around the second high-frequency terminal stowage recessed part.

7. A second connector configured to mate with a first connector, the second connector comprising:

a second connector body, the second connector body comprises a second mating guide part, the second mating guide part being formed on both ends of the second connector body in a longitudinal direction, the second mating guide part having a substantially rectangular shape from a plan view;

a second terminal mounted on the second connector body; and a second high-frequency connection unit mounted on the second connector body, the second high-frequency connection unit comprises a second high-frequency terminal and a second high-frequency shield, the second high-frequency shield having a square tube shape with a substantially rectangular cross-section, the second high-frequency shield extending in a mating direction to enclose around the second high-frequency terminal, wherein the second mating guide part is configured to be inserted in a first mating recess part of the first connector, wherein the second high-frequency connection unit is mounted in the second mating guide part, and wherein the second high-frequency terminal is configured to come into contact with a first high-frequency terminal of the first connector.

8. A connector assembly comprising:

a first connector; and a second connector mated with the first connector, wherein the first connector comprises:

a first connector body, the first connector body comprises a first recess and a first mating guide part, the first mating guide part being formed on both ends of the first connector body in a longitudinal direction, the first mating guide part being formed with a first mating recess part;

a first terminal mounted on the first connector body; and a first high-frequency connection unit mounted on the first connector body, the first high-frequency connection unit being formed in a substantially rectangular shape from a plan view, the first high-frequency connection unit comprises a first high-frequency terminal and a first high-frequency shield, the first high-frequency shield having a square tube shape with a substantially rectangular cross-section, the first high-frequency shield extending in a mating direction to enclose around a periphery of the first high-frequency terminal, wherein the second connector comprises:

a second connector body, the second connector body comprises a second mating guide part, the second mating guide part being formed on both ends of the second connector body in a longitudinal direction, the second mating guide part having a substantially rectangular shape from a plan view;

a second terminal mounted on the second connector body; and a second high-frequency connection unit mounted on the second connector body, the second high-frequency connection unit comprises a second high-frequency terminal and a second high-frequency shield, the second high-frequency shield having a square tube shape with a substantially rectangular cross-section, the second high-frequency shield extending in the mating direction to enclose around the second high-frequency terminal, wherein the recess of the first connector body mates with the second connector body of the second connector, wherein the first high-frequency connection unit is mounted in the first mating recess part, wherein the second mating guide part is inserted in the first mating recess part, wherein the second high-frequency connection unit is mounted in the second mating guide part, and wherein the second high-frequency terminal contacts the first high-frequency terminal.

* * * * *